US006197692B1

(12) United States Patent
Fushimi

(10) Patent No.: US 6,197,692 B1
(45) Date of Patent: Mar. 6, 2001

(54) SEMICONDUCTOR WAFER PLANARIZING DEVICE AND METHOD FOR PLANARIZING A SURFACE OF SEMICONDUCTOR WAFER BY POLISHING IT

(75) Inventor: Kimihisa Fushimi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/317,948

(22) Filed: May 25, 1999

(30) Foreign Application Priority Data

Jun. 9, 1998 (JP) ..... 10-160685

(51) Int. Cl.[7] ..... H01L 21/00

(52) U.S. Cl. ..... 438/692; 156/345; 216/88; 438/745

(58) Field of Search ..... 438/692, 693, 438/745, 747; 216/38, 88, 89; 156/345 LP

(56) References Cited

U.S. PATENT DOCUMENTS 5,534,106 * 7/1996 Cote et al. ..... 156/345 X
5,899,745 * 5/1999 Kim et al. ..... 438/692
5,985,090 * 11/1999 Kikuta et al. ..... 438/692 X

* cited by examiner

*Primary Examiner*—William Powell
(74) *Attorney, Agent, or Firm*—Junichi Mimura

(57) ABSTRACT

A semiconductor wafer planarizing device for polishing a surface of a semiconductor wafer comprises a polishing pad having a hard polishing area and a soft polishing area. In a method of planarizing a surface of the semiconductor wafer by using the device, times during which said semiconductor wafer contacts said first area or said second area of the polishing pad is controlled.

8 Claims, 5 Drawing Sheets

SEMICONDUCTOR WAFER PLANARIZING DEVICE AND METHOD FOR PLANARIZING A SURFACE OF SEMICONDUCTOR WAFER BY POLISHING IT

BACKGROUND OF THE INVENTION

1. Field of the Invention

The invention relates to a semiconductor wafer planarizing device and a method for planarizing a surface of a semiconductor wafer by polishing it, more particularly, to the semiconductor wafer planarizing device having a polishing pad made of different kinds of material on its surface.

2. Cross-Reference to Related Application

This application claims the priority benefit of Japanese Patent Application No. 10-160685, filed Jun. 9, 1998, the entire subject matter of which is incorporated herein of reference.

3. Description of the Related Art

Generally, a semiconductor device has a multi-layered structure which is comprised of conductive layers and insulating layers. The surface of an insulating layer formed on a patterned conductive layer is uneven generally because of a pattern of the conductive layer. As another conductive layer which is formed on the uneven insulating layer surface may not be patterned in an expected manner, the surface of the insulating layer should be planarized.

A device that has been used to planarize a semiconductor includes a polishing pad supported by a turntable which is rotated by a turntable motor. When the semiconductor wafer is held by a wafer chuck, the wafer is pressed by the wafer chuck against the polishing pad. The wafer chuck is rotated by a wafer chuck motor to polish the surface of the semiconductor wafer uniformly. As the wafer chuck is connected to an arm motor by a wafer chuck supporting arm and the wafer chuck motor, the wafer chuck is moved over the polishing pad by the arm motor. Slurry, which is a liquid for polishing having corpuscles, is applied to the polishing pad from a slurry supply nozzle. A method for planarizing the surface of the semiconductor wafer with such a semiconductor wafer planarizing device is explained below.

The turntable on which the polishing pad is placed is rotated, and pure water is then supplied onto the rotating polishing pad. The semiconductor wafer, which has an uneven surface, may be pneumatically held on the wafer chuck. Alternatively the semiconductor wafer may be held on the wafer chuck by surface tension of water. In any case, the wafer surface being polished is held so as to face the polishing pad. When the wafer chuck is rotated, slurry is ejected, in place of the pure water, from the slurry supply nozzle to the polishing pad, which continues to be rotated with the turntable. Then, the surface of the semiconductor wafer to be polished is pressed by the wafer chuck against the polishing pad. As the uneven surface of the semiconductor wafer is polished by friction between the semiconductor wafer and the slurry on the polishing pad, the surface of the semiconductor wafer is planarized.

Two kinds of polishing pad have been used. One is a hard type; the other a soft type. When the hard type of polishing pad is used, the shape of the polishing pad is of transformed by the pressure of the semiconductor wafer. Therefore, the surface of the semiconductor wafer is planarized. However, if the turntable is warped, the thickness of the polished layer will not be uniform, because the surface of the turntable and the surface of the semiconductor wafer will not be parallel. When the soft type of the polishing pad is used, the shape of the polishing pad is easily transformed by the pressure from the semiconductor wafer. Therefore, although the polishing is uniform, the surface of the semiconductor wafer is not planarized.

SUMMARY OF THE INVENTION

It is an object of the invention to provide an improved semiconductor wafer planarizing device to resolve the problems mentioned above.

It is another object of the Invention to provide an improved method for planarizing a surface of semiconductor wafer by polishing it.

To achieve these objects of the invention, there are provided that a semiconductor wafer planarizing device for polishing a surface of a semiconductor wafer having a polishing pad which is made of two kinds of material at its surface, and a method for planarizing the surface of semiconductor wafer using such a device.

An advantage of my invention is that with its use various step differences at the surface of the semiconductor wafer can be polished selectively, so that a planarized surface of the semiconductor wafer constantly can be obtained.

A further advantage of my invention is that an uniformed amount of the polish is performed. These advantages can be obtained simultaneously.

BRIEF DESCRIPTION OF THE DRAWINGS

The present invention will be more particularly described with reference to the accompanying drawings, in which.

DETAILED DESCRIPTION OF THE PREFERRED EMBODIMENT

Figure 1:
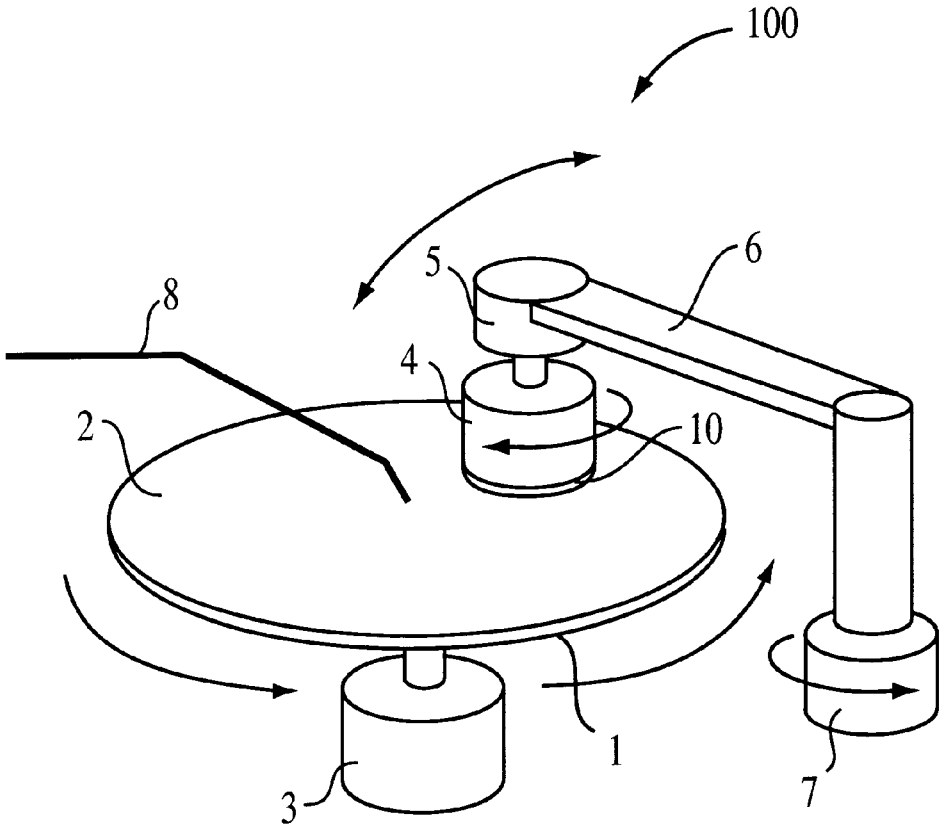
FIG. 1 is a perspective view of a rotating-type semiconductor wafer planarizing device, according to a first embodiment of the invention.

Referring to FIG. 1, the rotating type of the semiconductor wafer planarizing device 100 has a round turntable 1, a disk-shaped polishing pad 2, a turntable motor 3, a wafer chuck 4, a wafer chuck motor 5, a wafer chuck supporting arm 6, an arm motor 7, and a slurry supply nozzle 8.

The polishing pad 2 is supported by the turntable 1 which is in turn rotated by the motor 3. A semiconductor wafer 10 having an uneven surface is held by the wafer chuck 4. The wafer 10 is pressed by the wafer chuck 4 against the polishing pad 2. The wafer chuck 4 is rotated by the motor 5 to polish the surface of the semiconductor wafer 10 uniformly. As the wafer chuck 4 is connected to the arm motor 7 by the wafer chuck supporting arm 6 and the motor 5, the wafer chuck 4 can be moved over the polishing pad 2 by the arm motor 7. Slurry, which is a liquid for polishing having corpuscles, is applied to the polishing pad 2 from the slurry supply nozzle 8.

Figure 2:
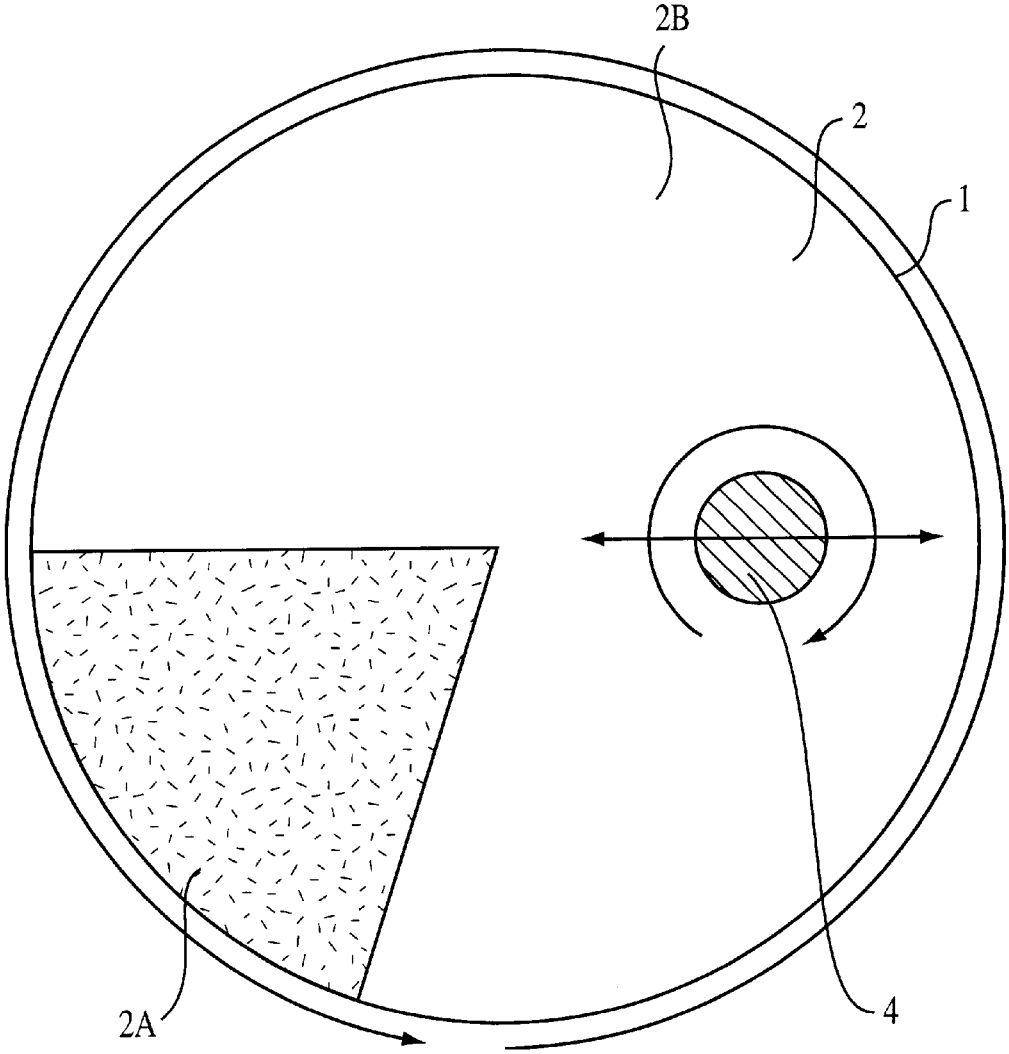
FIG. 2 is a plan view of a polishing pad of the first embodiment.

Referring to FIG. 2, the polishing pad 2 and the turntable 1 have the same diameter. The polishing pad 2 has different materials at two separate polishing areas 2A and 2B of its surface. In the area 2A, the material is hard; in the area 2B, the material is soft. In this embodiment, the hard polishing area 2A is drawn in fan shape; and the remainder of the surface is occupied by the soft polishing area 2B. In FIG. 2, the soft polishing area 2B makes up eighty percent of total area of polishing pad 2, and the hard polishing area 2A makes up twenty percent thereof.

The hard polishing area 2A comprises two layers of polyurethane. The upper polyurethane, which faces the surface of the semiconductor wafer, has a ninety-five shore hardness, and the bottom polyurethane has an eighty-two shore hardness. However, it is not necessary to restrict the material to polyurethane. It is within the scope of the invention to form the hard area and the soft area with different materials having different hardness or different elastic property.

The soft polishing area 2B also comprises two layers of polyurethane. The upper polyurethane, facing the surface of the semiconductor wafer has a ninety-five shore hardness, while the bottom polyurethane has a sixty-one shore hardness.

A method of planarizing the surface of a semiconductor wafer by polishing with the above-mentioned semiconductor wafer planarizing device, is explained below.

The turntable 1 on which the polishing pad 2 is placed, is rotated. Then pure water is applied onto the polishing pad 2 from the slurry supply nozzle 8. The semiconductor wafer 10, which has an uneven surface may be held pneumatically on the wafer chuck 4. Alternatively, the semiconductor wafer 10 may be held on the wafer chuck 4 by water surface tension. In any case, the wafer surface being polished is held facing the polishing pad 2. When the wafer chuck 4 is rotated, slurry is ejected, in place of the pure water, from the slurry supply nozzle 8 to the polishing pad 2 which continues to rotate with the turntable 1. Then, the surface of the semiconductor wafer 10 is pressed by the wafer chuck 4 against the polishing pad 2. The wafer chuck 4 is moved radially and substantially in a straight line along to the polishing pad surface toward to a center axis of the polishing pad 2. As the uneven surface of the semiconductor wafer 10 is polished by friction between the semiconductor wafer 10 and the slurry disposed between the semiconductor wafer 10 and the polishing pad 2, the surface of the semiconductor wafer 10 is planarized.

According to this method, the surface of the semiconductor wafer 10 contacts the hard polishing area 2A and soft polishing area 2B during each rotation of the polishing pad 2. While the surface of the semiconductor wafer 10 contacts the hard polishing area 2A, the unique effect of hard polishing area 2A is obtained. While the surface of the semiconductor wafer 10 contacts the soft polishing area 2B, the unique effect of the soft polishing area 2B is obtained. Therefore, each of unique effects of soft and hard polishing area 2A and 2B are obtained during each full rotation of the polishing pad 2. Further, these effects are mixed as the turntable 1 makes several rotations. An effect provided by the hard polishing area 2A is that a step difference at the surface of the semiconductor wafer 10 can be polished selectively, so that a fine planarization can be obtained. An effect of the soft polishing area 2B is that the uniformity of polishing amount is performed even if the turntable 1 is warped.

Further, it is possible to change the ratio of the hard and soft polishing in correspondence to the various shapes formed on the surface of the semiconductor wafer 10. For example, the total area of the polishing pad 2 can be divided into several (X) equal pieces. The area of the polishing pad 2 can consist of Y hard polishing area pieces and (X-Y) soft polishing area pieces.

Figure 3:
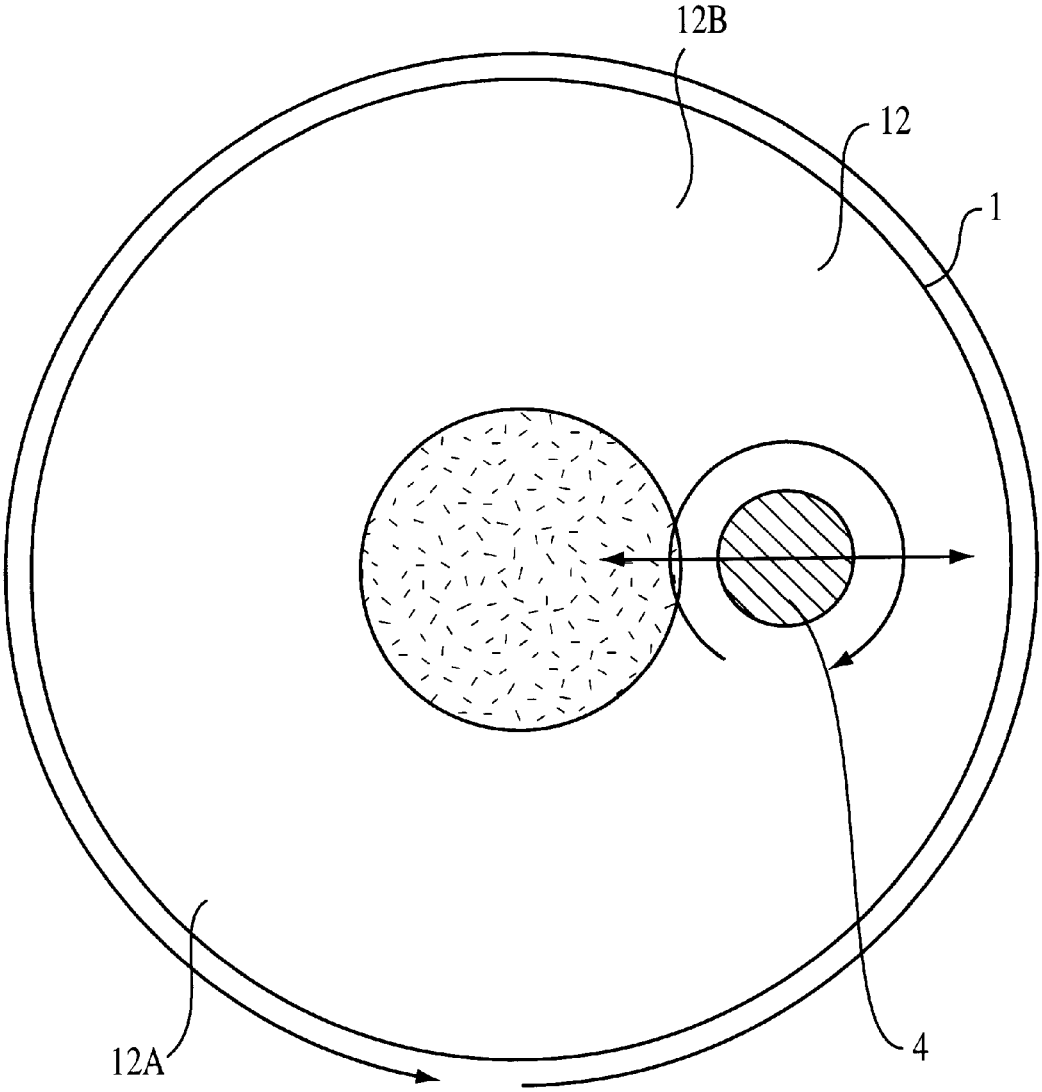
FIG. 3 is a plan view of an alternative polishing pad, according to the first embodiment.

Referring to FIG. 3, an alternative disk shaped polishing pad 12 has both hard and soft areas, but their shapes are much different than these of FIG. 2. Here, a hard polishing area 12A has a disk shape, and is a concentric with the outer boundary of the polishing pad 12. A ring-shaped soft polishing area 12B surrounds of disk-shaped area 12A. The material and composition of the hard and soft polishing areas preferably are the same as these described above for the pad illustrated in FIG. 2.

A method of planarizing the surface of a semiconductor wafer by polishing with the semiconductor wafer planarizing device 100 of FIG. 1, using the polishing pad 12, is explained below.

The turntable 1 on which the polishing pad 12 is placed, is rotated. Then pure water is applied onto the polishing pad 12 from the slurry supply nozzle 8. The semiconductor wafer, which has an uneven surface may be held pneumatically on the wafer chuck 4. Alternatively, the semiconductor wafer 10 may be held on the wafer chuck 4 by water surface tension of. In any case, the surface being polished is held facing to the polishing pad 12. When the wafer chuck 4 is rotated, slurry is ejected, in place of the pure water, from the slurry supply nozzle 8 to the polishing pad 12 which continues to rotate with the turntable 1. Then the surface of the semiconductor wafer 10 to be polished is pressed by the wafer chuck 4 against the polishing pad 12. The wafer chuck 4 is moved radially and substantially in a straight line along the surface of the polishing pad 12 to the pad's center axis. Times during which the semiconductor wafer 10 contacts the soft polishing area 12B or the hard polishing area 12A can be controlled by the arm motor 7. For example, the semiconductor wafer 10 can be held for five seconds on the hard polishing area 12A, and can be held for fifteen seconds on the soft polishing area 12B in a case in which the wafer chuck 4 takes twenty seconds to move from an edge to the center of the polishing pad 12. As the uneven surface of the semiconductor wafer 10 is polished by friction between the semiconductor wafer 10 and the slurry between the semiconductor wafer 10 and the polishing pad 2, the surface of the semiconductor wafer 10 is planarized.

When using the pad 12, then, in addition to the benefits obtained with use of the pad 2, this pad permits the ratio of the polishing with the hard polishing area 12A to polishing with the soft polishing area 12B to be change simply by controlling the arm motor 7. That is, it is not necessary to change the polishing pad when another semiconductor wafer having a different shape on its surface is polished. Therefore, the polishing pad 12 can be used to polish semiconductor wafers with various shapes of the step differences at their surfaces.

Figure 4:
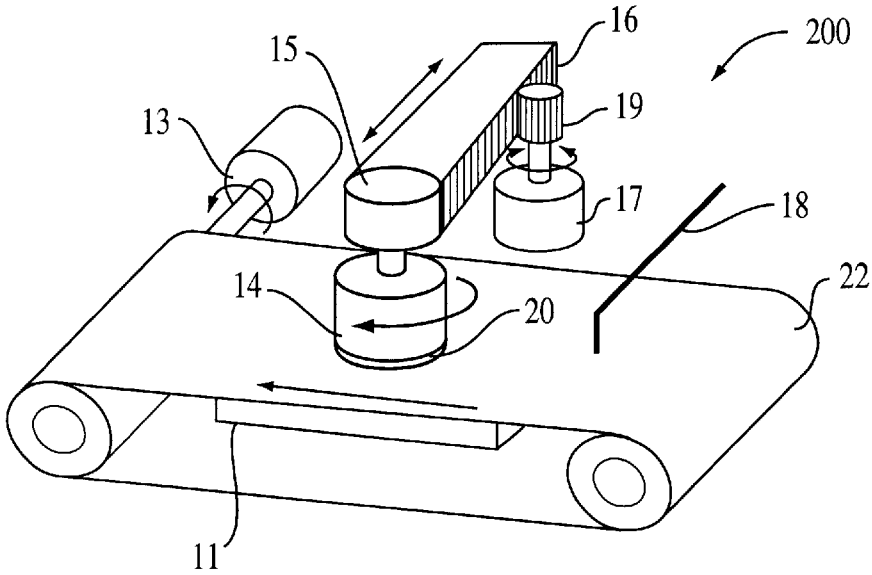
FIG. 4 is a perspective view of a belt-type semiconductor wafer planarizing device, according to a second embodiment of the invention.

A belt type semiconductor wafer planarizing device 200 according to a second embodiment of the invention will now be described. Referring to FIG. 4, the belt type of this semiconductor wafer planarizing device has a table 11, a polishing pad 22, a polishing pad motor 13, a wafer chuck 14, a wafer chuck motor 15, a wafer chuck supporting arm 16 having teeth on one vertical side, an arm motor 17, a slurry supply nozzle 18, and a gear 19 that engages the teeth of the arm 16.

The polishing pad 22 is supported by the table 11. The polishing pad 22, which is formed in a belt shape, is rotated by the motor 13. A semiconductor wafer 20 having an uneven surface is held by the wafer chuck 14. The wafer 20 is pressed by the wafer chuck 14 against the polishing pad 22. The wafer chuck 14 is rotated by the motor 15 to polish the surface of the semiconductor wafer 20 uniformly. As the wafer chuck 14 is connected to the motor 17 through the wafer chuck supporting arm 16, the motor 15 and the gear 19, the wafer chuck 14 can be moved by the motor 17 in a straight line and in a direction perpendicular to the direction of movement of the polishing pad 22. Slurry, as with the first embodiment, is applied to the polishing pad 22 from the slurry supply nozzle 18.

Figure 5:
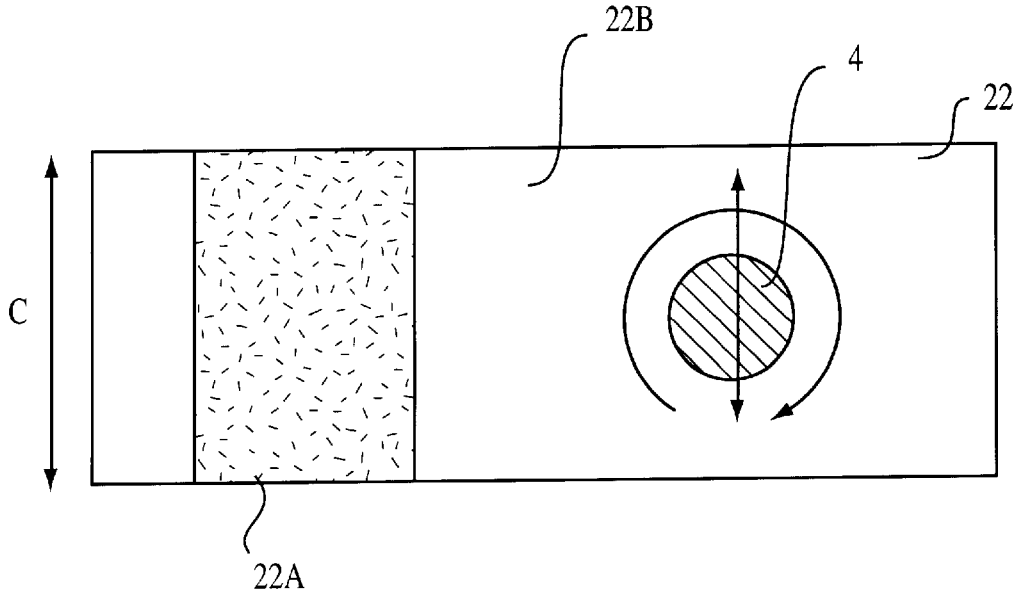
FIG. 5 is a plan view of a polishing pad of the second embodiment.

Referring to FIG. 5, the polishing pad 22 has a belt shape, with a hard polishing area 22A and a soft polishing area 22B. One end of the soft polishing area 22B is connected to the other end with the hard polishing area 22A to form the belt shape. In the pad 22, the width C of the hard polishing area 22A is the same that of the soft polishing area 22B. In the illustrated embodiment, the soft polishing area 22B makes up eighty percent of total area of polishing pad 22, and the hard polishing area 22A makes up twenty percent thereof. The material and composition of the hard and soft polishing areas preferably are the same as those the pad 2 described above with reference to FIG. 2.

A method of planarizing the surface of a semiconductor wafer by polishing with the semiconductor wafer planarizing device 200 of FIG. 4, using the polishing pad 22, is explained below.

The belt-shaped polishing pad 22 is moved linearly above and below the table 11, by the motor 13, while pure water is applied on the polishing pad 22 from the slurry supply nozzle 18. The semiconductor wafer 20, which has an uneven surface may be held pneumatically on the wafer chuck 14. Alternatively, the semiconductor wafer 20 may be held on the wafer chuck 14 by water surface tension. In any case, the surface of the semiconductor wafer 20 to be polished faces the polishing pad 22. When the wafer chuck 14 is rotated, slurry is ejected, in place of the pure water, from the slurry supply nozzle 18 onto the polishing pad 22. Then, the surface of the semiconductor wafer 20 to be polished is pressed by the wafer chuck 14 against the polishing pad 22. Then, the wafer chuck 14 moves in a straight line perpendicular to the direction of the movement of the polishing pad 22. As the uneven surface of the semiconductor wafer 20 is polished by friction between the semiconductor wafer 20 and the slurry between the semiconductor wafer 20 and the polishing pad 22, the surface of the semiconductor wafer 20 is planarized.

As with the first embodiment, an effect of the hard polishing area is that step differences on the surface of the semiconductor wafer 20 can be polished selectively, so that a fine planarization can be performed. Similarly, an effect of the soft polishing area is that uniformity in the amount of the polishing can be performed, even if the table 11 is warped.

Further, it is possible to change the ratio of the hard and soft polishing areas in correspondence to the various shapes that may be formed on the surface of the semiconductor wafer 20. For example, the total area of the polishing pad 22 can be divided into several (X) equal pieces. The area of the polishing pad 22 can consist of Y hard polishing area pieces and (X-Y) soft polishing area pieces.

Figure 6:
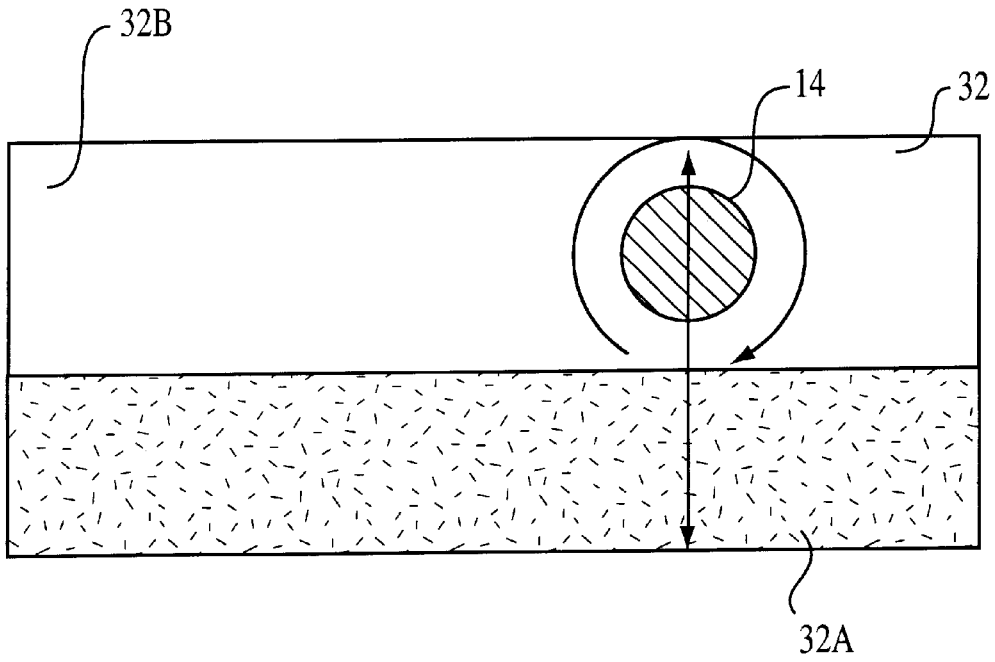
FIG. 6 is a plan view of an alternative polishing pad of the second embodiment.

Referring to FIG. 6, an alternative belt-shaped polishing pad 32 for use in the device 200 according to the second embodiment, has, side-by-side, a belt-shaped hard polishing area 32A and a belt-shaped soft polishing area 32B, connected to each other along a common edge. The material and composition of the hard polishing area 32A and the soft polishing area 32B are the same as the corresponding hard and soft polishing areas of the first embodiment.

A method of planarizing the surface of the semiconductor wafer by polishing with the semiconductor wafer planarizing device 200 of FIG. 4, using the polishing pad 32, is explained below.

The polishing pad 32 is moved linearly above and below the table 11, by the motor 13, while pure water is applied on the polishing pad 32 from slurry supply nozzle 18. The semiconductor wafer 20, which has an uneven surface may be held pneumatically on the wafer chuck 14. Alternatively, the semiconductor wafer 20 may be held on the wafer chuck 14 by water surface tension. In any case, the surface of the semiconductor wafer 20 to be polished faces the polishing pad 32. When, the wafer chuck 14 is rotated, slurry is ejected, in place of the pure water, from the slurry supply nozzle 18 onto the polishing pad 32. Then, the surface of the semiconductor wafer 20 to be polished is pressed by the wafer chuck 14 against the polishing pad 32. Then, the wafer chuck 14 moves in a straight line perpendicular to the direction of the movement of the polishing pad 32. Like the case of the pad 12 when used with the device in the first embodiment, times during which the semiconductor wafer 20 contacts the soft polishing area 32B or the hard polishing area 32A, can be controlled by the arm motor 17. For example, the semiconductor wafer 20 can be held for five seconds on the hard polishing area 32A, and can be held for fifteen seconds on the soft polishing area 32B in a case in which the wafer chuck 14 takes twenty seconds to move from one edge to the other edge of the polishing pad 32. As the uneven surface of the semiconductor wafer 20 is polished by friction between the semiconductor wafer 20 and the slurry disposed between the semiconductor wafer 20 and the polishing pad 32, the surface of the semiconductor wafer 20 is planarized.

When using the pad 32, then, in addition to the benefits obtained with use of the pad 22, the pad 32 permits the ratio of the amount of polishing with the hard polishing area 32A to the amount of polishing with the soft polishing area 12B to be change simply by controlling the arm motor 7. That is, like with use of the pad 12 with the device 100 of the first embodiment, it is not necessary to change the polishing pad when another semiconductor wafer having a different shape on its surface is polished. Therefore, the polishing pad 32 can be used to polish semiconductor wafers with various shapes of the step differences at their surfaces.

While the present invention has been described with reference to illustrative embodiments, this description is not intended to be construed in a limiting sense. Various modifications of the illustrated embodiments, as well as other embodiments of the invention, will be apparent to those skilled in the art on reference to this description. For example, the ratio of the hard polishing area and soft polishing area can be changed with the various shapes of the surface of the semiconductor wafer. Furthermore, the shore hardness of the polishing pad also can be changed with the various shapes of the surface of the semiconductor wafer. It is therefore contemplated that the appended claims will cover any such modifications or embodiments as fall within the true scope of the invention.

What I claim is:

1. A semiconductor wafer planarizing device for polishing a surface of a semiconductor wafer, comprising:

a table;

a disk-shaped polishing pad supported by the table, the pad having an exposed upper layer of a first hardness and a bottom layer in contact with the table, the bottom layer having a first area of a fan shape and a second area, the first area having a second hardness different than the first hardness, and the second area having a third hardness different than the first and second hardnesses; and a wafer chuck for holding the semiconductor wafer in contact with the upper layer of the pad.

2. A semiconductor wafer planarizing device as claimed in claim 1, further comprising:

a first motor connecting to said table so as to rotate said table;

a second motor connecting to said wafer chuck so as to rotate said semiconductor wafer;

a third motor; and an arm connecting said third motor to said second motor for moving said wafer chuck radially toward to a center axis of said polishing pad.

3. A semiconductor wafer planarizing device for polishing a surface of a semiconductor wafer, comprising:

a table;

a belt-shaped polishing pad supported by the table, the pad having an exposed outer layer of a first hardness and an inner layer in contact with the table, the inner layer having a first area and a second area, the first area having one end and an other end, the one end being connected to the other end with the second area to form the polishing pad in the belt shape, a wafer chuck for holding the semiconductor wafer in contact with the outer layer of the pad.

4. A method for planarizing a surface of a semiconductor wafer, comprising:

placing the semiconductor wafer on a wafer chuck, polishing the semiconductor wafer with a disk-shaped polishing pad which turns on its center axis, the polishing pad having an exposed upper layer of a first hardness in contact with the surface of the semiconductor wafer directly and a bottom layer, the bottom layer having a first area of a fan shape and a second area, the first area having a second hardness different than the first hardness, and the second area having a third hardness which is different from the first and second hardness, and moving the wafer chuck radially toward to a center axis of said polishing pad.

5. A method for planarizing a surface of a semiconductor wafer according to claim 4, further comprising:

controlling time periods during which the semiconductor wafer contacts the upper layer on the first area or on the second area of the bottom layer of the polishing pad.

6. A method for planarizing a surface of a semiconductor wafer, comprising:

placing the semiconductor wafer on a wafer chuck, polishing the semiconductor wafer with a belt-shaped polishing pad which is moved linearly in a direction, the pad having an exposed outer layer of a first hardness in contact with the surface of the semiconductor wafer directly and an inner layer, the inner layer having a first area and a second area, the first area having one end and an other end, the one end being connected to the other end with the second area to form the polishing pad in the belt shape, and moving the wafer chuck in a straight line perpendicular to the direction of the movement of the polishing pad.

7. A method for planarizing a surface of a semiconductor wafer according to claim 6, further comprising, controlling time periods during which the semiconductor wafer contacts the outer layer on the first area or on the second area of the inner layer of the polishing pad.

8. A semiconductor wafer planarizing device as claimed in claim 3 further, comprising:

a first motor coupled to the pad for moving the pad linearly along a surface of the table;

a second motor connecting to the wafer chuck to rotate the semiconductor wafer;

an arm having teeth on one side and connected to the second motor;

a gear engaging the teeth of the arm; and a third motor connected to the gear so as to move the wafer chuck and the second motor in a straight line perpendicular to a direction of the movement of the polishing pad.

* * * * *